US008958196B2

(12) United States Patent
Takeda

(10) Patent No.: US 8,958,196 B2
(45) Date of Patent: Feb. 17, 2015

(54) ELECTRIC CIRCUIT CONNECTED TO THERMAL SWITCH WITH THREE TERMINALS

(75) Inventor: Hideaki Takeda, Saitama (JP)

(73) Assignee: Uchiya Thermostat Co., Ltd. (JP)

( * ) Notice: Subject to any disclaimer, the term of this patent is extended or adjusted under 35 U.S.C. 154(b) by 324 days.

(21) Appl. No.: 13/503,238

(22) PCT Filed: Aug. 4, 2010

(86) PCT No.: PCT/JP2010/063199

§ 371 (c)(1),
(2), (4) Date: Apr. 20, 2012

(87) PCT Pub. No.: WO2011/055577

PCT Pub. Date: May 12, 2011

(65) Prior Publication Data

US 2012/0212210 A1 Aug. 23, 2012

(30) Foreign Application Priority Data

Nov. 4, 2009 (JP) ..... 2009-253132

(51) Int. Cl.
*H01H 37/32* (2006.01)
*H01H 1/50* (2006.01)
(Continued)

(52) U.S. Cl.
CPC ..... *H01H 1/504* (2013.01); *H01H 9/42* (2013.01); *H01H 37/54* (2013.01); *H01H 2037/5481* (2013.01)
USPC ..... 361/124

(58) Field of Classification Search
CPC ..... H01H 1/504; H01H 37/32; H01H 37/54; H01H 9/42; H01H 2037/5481; H01T 1/14; H01C 7/126; H02H 9/042
USPC ..... 361/124
See application file for complete search history.

(56) References Cited

U.S. PATENT DOCUMENTS 3,840,834 A 10/1974 Obenhaus et al.
4,092,573 A 5/1978 D'entremont
(Continued)

FOREIGN PATENT DOCUMENTS

DE 10030711 A1 2/2001
GB 2295925 A 6/1996
(Continued)

OTHER PUBLICATIONS

"International Application Serial No. PCT/JP2010/063199, International Search Report mailed Nov. 9, 2010", 2 pgs.
(Continued)

*Primary Examiner* — Jared Fureman
*Assistant Examiner* — Kevin J Comber
(74) *Attorney, Agent, or Firm* — Schwegman Lundberg & Woessner, P.A.

(57) ABSTRACT

An electric circuit connected to a thermal switch with three terminals and a method for connecting the switch are realized. In an electric circuit of a common power supply, an external connection wire (first terminal) of a thermal switch arranged close to a current limiting resistor is connected to a load side (rectifier circuit), the current limiting resistor is connected between the external connection wire (first terminal) and an external connection wire (second terminal), and an external connection wire (third terminal) is connected to the output side of a power supply switch. Thus, the current limiting resistor is connected and arranged to an internal resistor unit of the thermal switch in series and to a switch unit (contact) in parallel.

4 Claims, 6 Drawing Sheets

(51) Int. Cl.

| | |
|---|---|
| ***H01H 9/42*** | (2006.01) |
| ***H01H 37/54*** | (2006.01) |

(56) References Cited

U.S. PATENT DOCUMENTS

| | | | | |
|---|---|---|---|---|
| 4,278,960 | A | 7/1981 | Muller et al. | |
| 5,247,273 | A * | 9/1993 | Shibayama et al. | 337/16 |
| 5,621,376 | A | 4/1997 | Takeda | |
| 5,689,173 | A * | 11/1997 | Oosaki et al. | 429/7 |
| 5,757,262 | A | 5/1998 | Takeda | |
| 5,804,798 | A | 9/1998 | Takeda | |
| 5,847,637 | A | 12/1998 | Takeda et al. | |
| 6,281,780 | B1 | 8/2001 | Sugiyama et al. | |
| 6,316,878 | B1 | 11/2001 | Tsukada | |
| 6,346,796 | B1 | 2/2002 | Takeda | |
| 6,396,381 | B1 | 5/2002 | Takeda | |
| 6,414,285 | B1 | 7/2002 | Takeda | |
| 6,633,222 | B2 | 10/2003 | Nagai et al. | |
| 6,756,876 | B2 | 6/2004 | Sullivan et al. | |
| 7,026,907 | B2 | 4/2006 | Takeda | |
| 7,330,097 | B2 | 2/2008 | Takeda | |
| 8,289,124 | B2 | 10/2012 | Hofsaess | |
| 2003/0058079 | A1 | 3/2003 | Sulliva et al. | |
| 2012/0001721 | A1 * | 1/2012 | Takeda | 337/372 |
| 2012/0032773 | A1 * | 2/2012 | Takeda | 337/362 |

FOREIGN PATENT DOCUMENTS

| | | | |
|---|---|---|---|
| JP | 64-31643 | U | 2/1989 |
| JP | 62-0571 | A | 1/1994 |
| JP | 11-86703 | A | 3/1999 |
| JP | 11-86803 | A | 3/1999 |
| JP | 11-297173 | A | 10/1999 |
| JP | 11-341677 | A | 12/1999 |
| JP | 2000-323103 | A | 11/2000 |
| JP | 2002-204525 | A | 7/2002 |
| JP | 3393981 | B2 | 4/2003 |
| JP | 2003-141977 | A | 5/2003 |
| JP | 2003-203803 | A | 7/2003 |
| JP | 2004-080419 | A | 3/2004 |
| JP | 2004-133568 | A | 4/2004 |
| JP | 2005-237124 | A | 9/2005 |
| JP | 2005-274886 | A | 10/2005 |
| JP | 2006-202078 | A | 8/2006 |
| WO | WO-2005/081276 | A1 | 9/2005 |
| WO | WO-2010/103590 | A1 | 9/2010 |
| WO | WO-2010/103599 | A1 | 9/2010 |
| WO | WO-2011055577 | A1 | 5/2011 |

OTHER PUBLICATIONS

"U.S. Appl. No. 13/203,960, Non Final Office Action mailed Dec. 26, 2013", 3 pgs.
"U.S. Appl. No. 13/203,960, Notice of Allowance mailed May 12, 2014", 10 pgs.
"U.S. Appl. No. 13/203,960, Response filed Mar. 26, 2014 to Non Final Office Action mailed Dec. 26, 2013", 8 pgs.
"U.S. Appl. No. 13/203,960, Response filed Nov. 11, 2013 to Restriction Requirement mailed Oct. 10, 2013", 9 pgs.
"U.S. Appl. No. 13/203,960, Restriction Requirement mailed Oct. 10, 2013", 6 pgs.
"U.S. Appl. No. 13/254,698, Non Final Office Action mailed Oct. 15, 2013", 15 pgs.
"Chinese Application Serial No. 200980157811.X, Office Action dated Jul. 3, 2013", (w/ English Translation), 7 pgs.
"International Application Serial No. PCT/JP2009/005986, International Preliminary Report on Patentability dated Oct. 18, 2011", (w/ English Translation), 11 pgs.
"International Application Serial No. PCT/JP2009/005986, International Search Report mailed Dec. 22, 2009", (w/ English Translation), 2 pgs.
"International Application Serial No. PCT/JP2009/005986, Written Opinion mailed Dec. 22, 2009", (w/ English Translation), 9 pgs.
"International Application Serial No. PCT/JP2009/007053, International Preliminary Report on Patentability dated Oct. 18, 2011", (w/ English Translation), 8 pgs.
"International Application Serial No. PCT/JP2009/007053, International Search Report mailed Jan. 19, 2010", (w/ English Translation), 3 pgs.
"International Application Serial No. PCT/JP2009/007053, Written Opinion mailed Jan. 19, 2010", (w/ English Translation), 9 pgs.
"Chinese Application Serial No. 201080048779.4, Second Notice of the Opinion mailed Mar. 20, 2014", (w/ English Translation), 9 pgs.
"International Application Serial No. PCT/JP2010/063199, International Preliminary Report on Patentability dated May 8, 2012", (w/ English Translation), 10 pgs.
"International Application Serial No. PCT/JP2010/063199, Written Opinion mailed Nov. 9, 2010", (w/ English Translation), 8 pgs.

* cited by examiner

ELECTRIC CIRCUIT CONNECTED TO THERMAL SWITCH WITH THREE TERMINALS

RELATED APPLICATIONS

This application is a U.S. National Stage Filing under 35 U.S.C. §371 of International Application No. PCT/JP2010/063199, filed on Aug. 4, 2010, and published as WO 2011/055577 A1 on May 12, 2011, which claims priority to Japanese Application No. 2009-253132, filed Nov. 4, 2009, which applications and publications are incorporated herein by reference in their entirety.

TECHNICAL FIELD

The present invention relates to an electric circuit to which a thermal switch with three terminals is connected and a method for connecting the switch, and more specifically to an electric circuit to which a thermal switch with three terminals which can be a low power loss, general purpose, low price, small, and repeatedly used switch for protecting a component to be protected in the electric circuit is connected, and a method for connecting the switch.

BACKGROUND ART

A power supply capable of generating a specified DC voltage from an AC power supply is a known prior art. The power supply is generally provided with a smoothing circuit having a large-capacity capacitor after a rectifying device.

A large current instantaneously passes through a large-capacity capacitor by accumulated power immediately after energization. The current may reach some tens through hundred amperes. If the instantaneous current is too large, the life of a power supply switch, a rectifying diode, etc. is affected badly.

To avoid the harmful effect, a rush current passing through the rectifying diode and the capacitor when the power supply switch is input is generally reduced by limiting the current of an output circuit by serially arranging current limiting resistors on the downstream of the power supply switch of the power supply.

However, since a current loss grows when a fixed resistance is used for current limiting, a power thermistor, which is a large NTC (negative temperature coefficient) thermistor with a low resistance, is generally used.

The thermistor normally has a room temperature resistance of several to 20Ω, and the resistance is reduced to about 1/10 after limiting the rush current. Therefore, the current limiting effect cannot sufficiently work if the power supply is powered up immediately after cutting off the power supply before the cooling time of the thermistor is not long enough with the resistance not reaching the room temperature resistance.

It is a hot start state, and the current exceeding the current limit value of the component configuring the electric circuit of a switch, a rectifying diode, a smoothing capacitor, etc. passes through the electric circuit energized in this state. Then, the short circuit of the rectifying diode, the short circuit of the smoothing capacitor, etc. occur, and damage the current limiting resistor by a fire, and may damage the switch.

To prevent the component in the electric circuit having the current limiting resistor from being damaged, there is, for example, the technology proposed for short-circuiting both ends of the current limiting resistor using a relay (for example, refer to patent document 1).

In another example, there is the technology of a power supply circuit proposed for suppressing a rush current of a switching power supply using a complicated circuit configuration (for example, refer to patent document 2).

In a further example, to prevent the damage by a fire of the current limiting resistor due to a rush current, there is the technology proposed by opening and closing a bimetal switch (for example, refer to patent document 3).

In a further example, to protect a lightning arrestor in an example of an electric circuit provided with the lightning arrestor, there is the proposed technology in which a resistor and a thermal fuse are serially connected to the lightning arrestor (for example, refer to patent document 4).

In another example of protecting a lightning arrestor, there is the technology for suppressing the abnormal heat generation by generating a gap in series with the lightning arrestor in an abnormal state (for example, refer to patent document 5).

PATENT DOCUMENTS

Patent Document 1: Japanese Laid-open Patent Publication No. 2004-080419

Patent Document 2: Japanese Laid-open Patent Publication No. 2005-274886

Patent Document 3: Japanese Laid-open Patent Publication No. 2004-133568

Patent Document 4: Japanese Laid-open Patent Publication No. 11-341677

Patent Document 5: Japanese Laid-open Patent Publication No. 2003-203803

DISCLOSURE OF INVENTION

However, the prior art disclosed in the patent document 1 aims at preventing the damage by a fire of a current limiting resistor, and consumes power in driving a relay. Therefore, there is the problem of a power loss.

In addition, the prior art disclosed by the patent document 2 is to suppress the rush current passing at the energization of the smoothing capacitor of a switching power supply and the heater of an image forming device. Therefore, the use of the art is limited to a specific application, and the art is not for general use.

The prior art disclosed in the patent document 3 uses a heat sink to limit the rush current although the time interval from turning off the power supply switch to turning on the switch is short, that is, to quickly recover a bimetal switch. Therefore, there is the problem of an expensive and large device.

The prior art disclosed in the patent document 4 has the problem that reuse is not performed using a thermal fuse, and the thermal fuse is to be replaced inconveniently.

Furthermore, the prior art disclosed in the patent document 5 is not to be reused after abnormal heat generation when the lightning arrestor is a varistor, which is the problem to be solved.

To solve the problem above, the present invention aims at providing an electric circuit to which a thermal switch with three terminals which can be a low power loss, general purpose, low price, small, and repeatedly used switch for protecting a component to be protected in various electric circuits is connected, and a method for connecting the switch.

In this invention, an electric circuit is connected to a thermal switch with three terminals including: a fixed conductor having a fixed contact; a first terminal incorporated into the fixed conductor as a unitary construction for external connection; a movable plate formed by an elastic substance provided with a movable contact facing the fixed contact and having a specified contact pressure; a second terminal formed at an opposite end point with respect to the movable contact of the movable plate for external connection; a third terminal provided adjacent to an internal resistor unit and formed as branching from contact by a slit from an end portion where the second terminal is formed; and a bimetal element engaged with the movable plate and inverted at a specified temperature. The thermal switch with three terminals has a configuration of the contact which is in an OFF position in a normal temperature, and closes the contact according to a thermal operation. With the configuration, the electric circuit includes a current limiting resistor which is connected between the first and second terminals, the third terminal is connected to a power supply side and the first terminal is connected to a load side, or the third terminal is connected to the load side and the first terminal is connected to the power supply side.

The electric circuit above can also be connected to a thermal switch with three terminals having a lightning arrestor used in equipment connected to an AC or a DC. In this case, the lightning arrestor can be connected between the first and third terminals, the second terminal is connected to the power supply side and the first terminal is connected to a ground side, or the second terminal is connected to the ground side and the first terminal is connected to the power supply side.

Furthermore, a connecting method for connecting a thermal switch with three terminals according to the present invention to an electric circuit connects a thermal switch with three terminals including: a fixed conductor having a fixed contact; a first terminal incorporated into the fixed conductor as a unitary construction for external connection; a movable plate formed by an elastic substance provided with a movable contact facing the fixed contact and having a specified contact pressure; a second terminal formed at an opposite end point with respect to the movable contact of the movable plate for external connection; a third terminal provided adjacent to an internal resistor unit and formed as branching from contact by a slit from an end portion where the second terminal is formed; and a bimetal element engaged with the movable plate and inverted at a specified temperature. The thermal switch with three terminals has a configuration of the contact which is in an OFF position in a normal temperature, and closes the contact according to a thermal operation. With the configuration, the electric circuit includes a current limiting resistor which is connected between the first and second terminals, the third terminal is connected to a power supply side and the first terminal is connected to a load side, or the third terminal is connected to the load side and the first terminal is connected to the power supply side.

The electric circuit by the electric circuit connecting method with the thermal switch with three terminals can be, for example, an electric circuit having a lightning arrestor used in equipment connected to an AC or a DC. In this case, the lightning arrestor can be connected between the first and third terminals, the second terminal is connected to the power supply side and the first terminal is connected to a ground side, or the second terminal is connected to the ground side and the first terminal is connected to the power supply side.

The electric circuit connected the thermal switch with three terminals and the switch connecting method according to the present invention have an effect of a low power loss, general purpose, low price, small, and repeatedly used switch for protecting a component to be protected in various electric circuits.

BEST MODE FOR CARRYING OUT THE INVENTION

The embodiments of the present invention are described below in detail.

Embodiment 1

Figure 1:
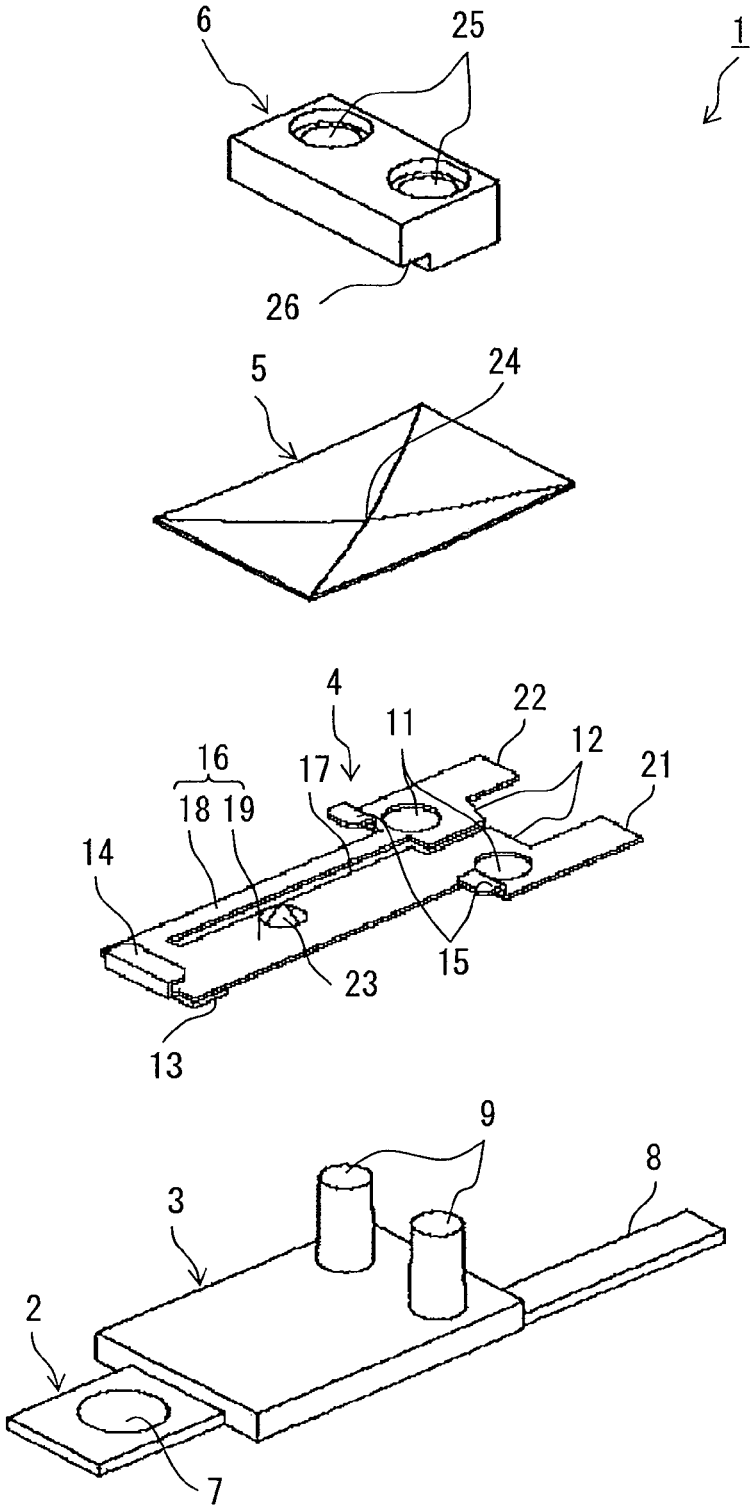
FIG. 1 is a perspective view of an analyzed configuration of the body of a thermal switch with three terminals according to the embodiment 1 or 2.

FIG. 1 is a perspective view of an analyzed configuration of the body of the thermal switch according to the embodiment 1. As illustrated in FIG. 1, a body 1 of the thermal switch is configured by a fixed conductor 2, an insulator 3, a movable plate 4, a bimetal 5, and a resin block 6.

The fixed conductor 2 includes a fixed contact 7 provided at one end and a first terminal 8 formed at an opposite end point of the end portion provided with the fixed contact 7 for external connection.

The insulator 3 is a resin mould between the fixed contact 7 of the fixed conductor 2 and the first terminal 8. The insulator 3 includes two columns 9 formed as a unitary construction of a resin mould.

The movable plate 4 includes a fixing unit 12 having a hole 11 fitting to the column 9 on the insulator 3, and a movable contact 13 formed facing the fixed contact 7 of the fixed conductor 2 on the opposite end point with respect to the fixing unit 12.

Furthermore, the movable plate 4 includes one hooked nail 14 and two hooked nails 15 for holding the bimetal 5 on the movable end side on which the movable contact 13 is located and on the fixing end side on which the fixing unit 12 is formed.

The movable plate 4 is provided with a long slit 17 formed by a slit made parallel to the side portion at the position closer to one side portion on a bimetal holding plane 16 between the hooked nail 14 and the hooked nail 15.

The bimetal holding plane 16 is separated into a narrow unit 18 and a wide unit 19 by the long slit 17. The long slit 17 further separates the fixing unit 12 substantially at the center to the end portion continuously after separating the narrow unit 18 from the wide unit 19.

The separated fixing unit 12 has a second terminal 21 made for an external connection at the end portion extending from the wide unit 19, and a third terminal 22 made for an external connection at the end portion extending from the narrow unit 18. With the formation, the narrow unit 18 configures an internal resistor unit of the body 1 of the thermal switch.

The width of the narrow unit 18 and the length of the slit 17 which form the internal resistance are respectively about ⅕ of the entire width, and the span from the fixing unit 12 to the vicinity of the movable contact 13 in FIG. 1, but the width and the length are not limited to these applications, but determined depending on the entire resistance of the electric circuit into which the components are incorporated, and on the performance of each incorporated part.

The shape of the body 1 of the thermal switch can be also described as obtained by the movable plate 4 including the internal resistor unit (narrow unit 18) formed as branching from the wide unit 19 from the movable contact 13 to the fixing unit 12 by the slit from the end portion (fixing unit 12) having the second terminal 21, thereby forming the third terminal 22 at the end portion of the internal resistor unit.

Furthermore, a projection 23 is formed substantially at the center in the longer direction of the wide unit 19 of the movable plate 4, and substantially at the center in the shorter direction of the bimetal holding plane 16.

The bimetal 5 is formed to have a concave central portion 24 at a normal temperature as illustrated in FIG. 1 by a drawing process, and the central portion 24 is inversely warped at a temperature higher than the normal temperature, thereby having the convex central portion 24.

The resin block 6 has a through hole 25 fitting to the column 9 of the insulator 3 with the lower portion provided with a step part 26 as an escape portion from the hooked nail 15 at the fixing end side of the movable plate 4 when the entire incorporation is completed.

The incorporation of each member illustrated in FIG. 1 is started by inserting the column 9 of the insulator 3 into the hole 11 of the fixing unit 12 of the movable plate 4. Thus, the movable plate 4 is incorporated into the fixed conductor 2 whose central portion is insulated by the insulator 3.

Next, the both end portions (diagonally left below and diagonally right above) of the bimetal 5 are engaged in the hooked nail 14 and two hooked nails 15 of the movable plate 4. Thus, the bimetal 5 is incorporated into the movable plate 4.

Then, the column 9 of the insulator 3 is passed through the through hole 25 of the resin block 6. The fixing unit 12 of the movable plate 4 is held by the resin block 6 and fixed to the insulator 3, the tip of the resin column 9 is melt to hold the resin block 6 by the column 9, and the resin block is fixed to the insulator 3, thereby completing the incorporation.

Figure 2:
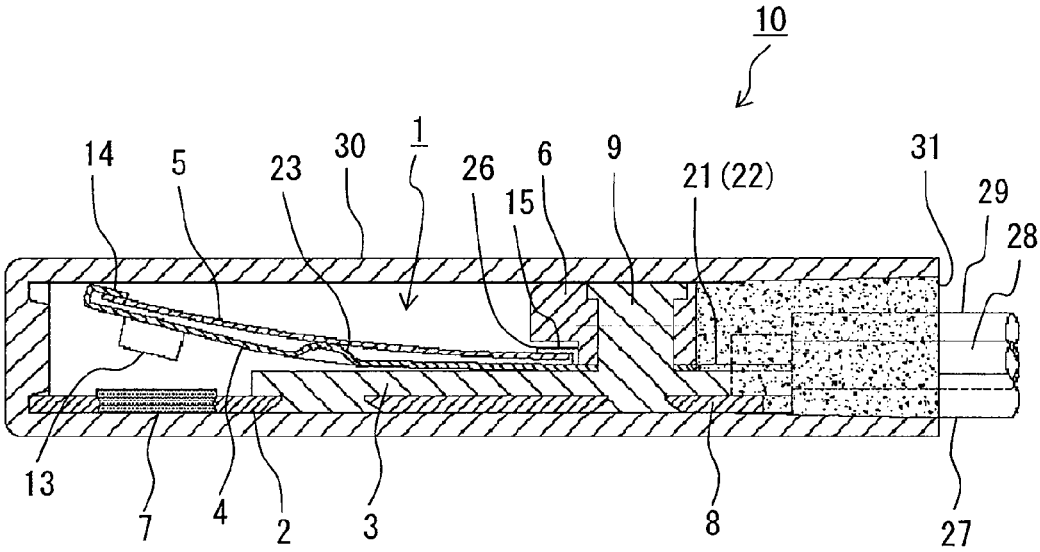
FIG. 2 is a side sectional view of the thermal switch with three terminals completed as a part by incorporating the assembled body illustrated in FIG. 1.

FIG. 2 is a side sectional view of the thermal switch with three terminals completed as a part by incorporating the assembled body 1 of the thermal switch. In FIG. 2, the same components as those illustrated in FIG. 1 are denoted with the same reference numerals as those of FIG. 1.

As illustrated in FIG. 2, a completely assembled thermal switch 10 with three terminals has external connection wires 27, 28, and 29 connected to the first terminal 8, the second terminal 21, and the third terminal 22, and is incorporated with apart of the wires into a rectangular parallelepiped insulating housing 30 whose surface (right surface in FIG. 2) is open. Then, the aperture of the housing 30 is enclosed by an enclosure member 31.

In the thermal switch 10 with three terminals, the bimetal 5 lifts one hooked nail 14, that is, the end portion side of the movable contact 13 of the movable plate 4, based on the principles of the lever using the projection 23 of the movable plate 4 as a fulcrum and the two hooked nails 15 as a holding units in the normal temperature, thereby configuring the contact in the OFF state in the normal temperature.

If the bimetal 5 is thermally operated and inverted at a specified temperature, the end portion where the movable contact 13 of the movable plate 4 is located is moved down to contact the fixed contact 7. In this case, the movable plate 4 has appropriate elasticity to enable the movable contact 13 to contact the fixed contact 7 with a specified contact pressure.

The thermal switch 10 with the three terminals configured as described above according to the embodiment 1 can be used in the power supply for generating a DC voltage. When the switch is used, it is arranged close to the current limiting resistor for limiting a rush current.

Figure 3:
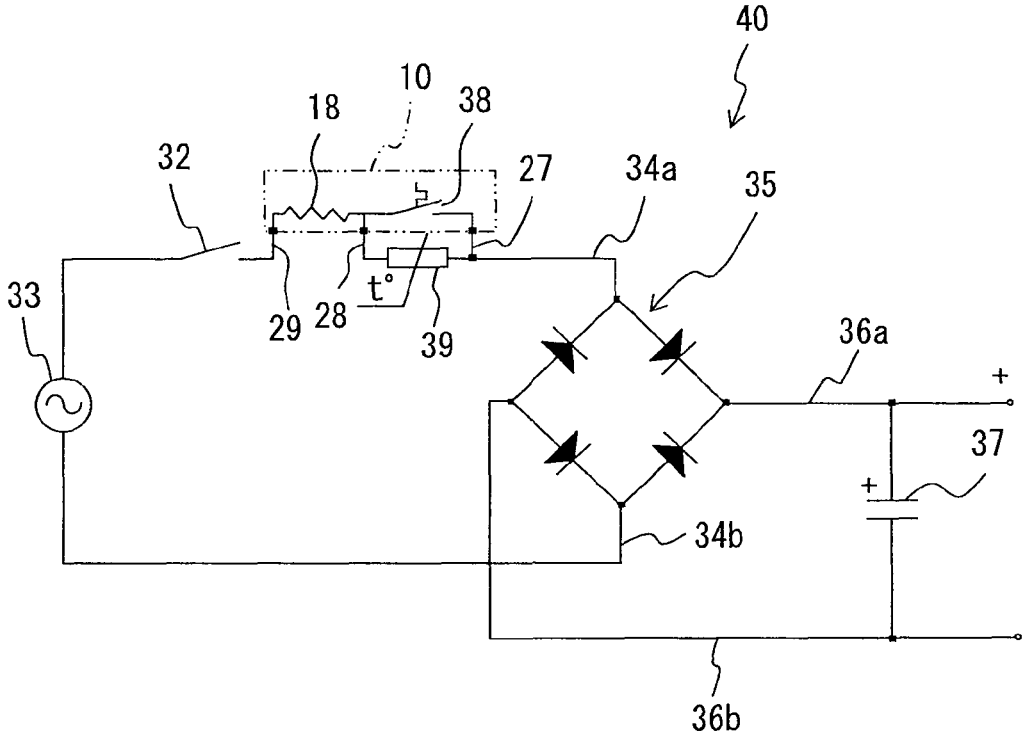
FIG. 3 is an example of connecting the thermal switch with three terminals illustrated in FIG. 2 to the electric circuit of a common power supply for supplying a DC voltage from an AC power supply as the embodiment 1.

FIG. 3 is an example of incorporating (connecting) the thermal switch 10 with three terminals according to the present embodiment (hereafter referred to simply as a thermal switch 10) to the electric circuit 40 of a common power supply for supplying a DC voltage from an AC power supply.

In the electric circuit 40 illustrated in FIG. 3, receives AC power at the primary side of a rectifier circuit 35 from an AC power supply 33 through wirings 34*a* and 34*b*. After the AC voltage is input to the primary side, it is rectified by the diode of the rectifying device of the rectifier circuit 35, and output from the secondary side through the output wirings 36*a* and 36*b*.

Since the DC voltage output from the secondary side is an undulating voltage as is, it is smoothed by the smoothing circuit of a capacitor 37 connected parallel to the rectifier circuit 35 between the output wirings 36*a* and 36*b*, and supplied to an external load from the end portion terminal of the output wirings 36*a* and 36*b*.

The thermal switch 10 is close to a current limiting resistor 39, and the current limiting resistor 39 is connected between the external connection wire 27 (first terminal 8) and the external connection wire 28 (second terminal 21).

Thus, a switch unit 38 configured by the fixed contact 7 and the movable contact 13 is arranged as connected parallel to the current limiting resistor 39. In FIG. 3, the above-mentioned external connection wire 27 (first terminal 8) is connected to the external load side (rectifier circuit 35 in FIG. 2) on the other side.

In this state, the external connection wire 29 (third terminal 22) is connected to the output side of the power supply switch 32. Thus, the internal resistor unit (narrow unit 18) between the external connection wire 28 (second terminal 21) and the external connection wire 29 (third terminal 22) is arranged as connected in series with the current limiting resistor 39.

Although the connections of the external connection wires 27 and 29 to an electric circuit 40 are exchanged, that is, although the external connection wire 27 is connected to the power supply side (power supply switch 32), and the external connection wire 29 (third terminal 22) is connected to the load side (wiring 34*a*), the current limiting resistor 39 is still connected parallel to the switch unit 38, and in series to the internal resistor unit (narrow unit 18).

Thus, in the electric circuit 40 connected to the thermal switch 10, if a current passes through the electric circuit 40 with the power supply switch 32 placed in the ON state, then the rush current is limited by the serially connected internal resistor unit (narrow unit 18) and the current limiting resistor 39.

Furthermore, the energization current heats the internal resistor unit by the Joule heat, and the temperature rise is added to the heat temperature of the current limiting resistor 39. Thus, the operation of the bimetal 5 of the thermal switch 10 is accelerated, the switch unit 38 of the thermal switch 10 is quickly closed, and both ends of the current limiting resistor 39 are short circuited.

That is, the thermal switch 10 can be short circuited without largely raising the temperature of the current limiting resistor 39 as compared with the case in which the operation starts only by detecting the temperature of the current limiting resistor 39. After the short circuit, most of the currents pass to the contact side (switch unit 38).

By the short circuit, since the current limiting resistor 39 which is a heat source for operating the thermal switch 10 has the short circuited terminal currents on both end units, the current suddenly decreases, the heat generation stops, and the temperature drops to the ambient temperature, thereby recovering the resistance up to the level at which the rush current limiting function can work.

On the other hand, the temperature of the thermal switch 10 also drops by the stop of the heat generation of the current limiting resistor 39, but the internal resistor unit still generates heat. Therefore, the current temperature maintains the inverse state of the bimetal 5, that is, the self-holding operation for suppressing the recovery can be maintained. Thus, the short-circuited state by the thermal switch 10 can be maintained.

If the power supply switch 32 is turned off and the power supply stops, then the temperature suddenly drops because the internal resistor unit of the thermal switch 10 has a small heat capacity, and the bimetal 5 can be recovered in a short time. That is, the thermal switch 10 can be recovered in a short time to open the switch unit 38.

Although the power supply switch 32 is turned on again and the power supply is powered up again, the current limiting function largely remains because the temperature of the current limiting resistor 39 has dropped and the resistance has increased. Therefore, an excess current does not pass through the electric circuit 40 when the power supply is powered up again in a short time. Therefore, the problem caused by the hot start can be solved.

Figure 4:
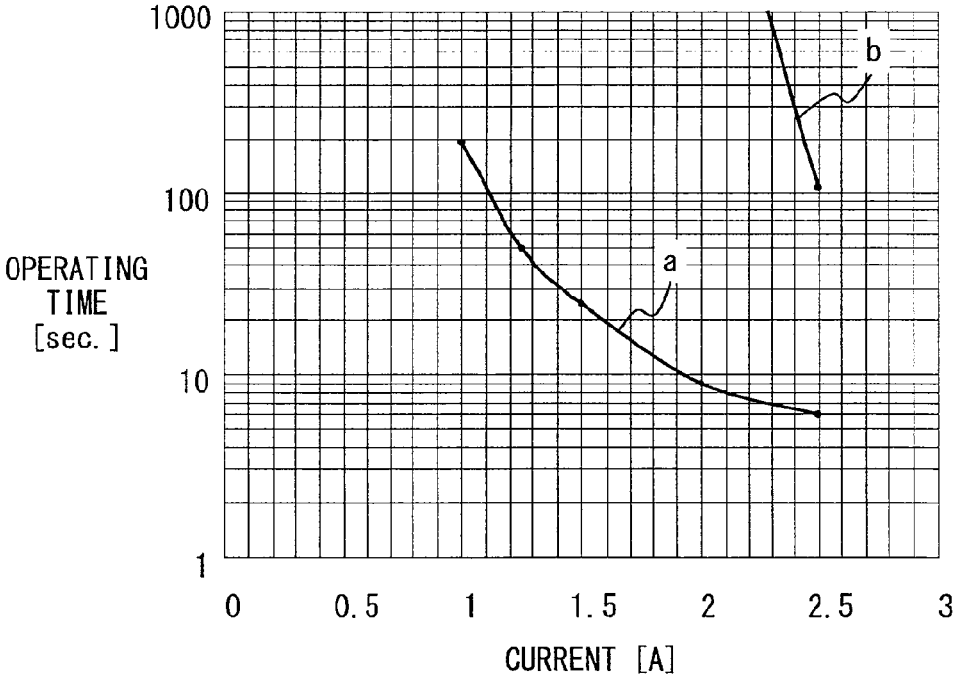
FIG. 4 is a view for comparing the relationship of the current to the operating time between the case in which the thermal switch with three terminals is connected in the electric circuit illustrated in FIG. 3 and the case in which a normal thermal switch is connected.

FIG. 4 is a view of the relationship of the current to the operating time between the case in which a normal thermal switch is used and the case in which the thermal switch having the internal resistor unit according to the present embodiment is used. In FIG. 4, the horizontal axis indicates the current (A), and the vertical axis indicates the operating time (sec) in log scale. The curve a indicates the thermal switch 10 according to the present embodiment, and the curve b indicates the relationship between each current of a normal thermal switch and the operating time.

As indicated by the curve b in FIG. 4, since a normal thermal switch operates by the heat generation temperature of the current limiting resistor 39, it does not operate until the current exceeds 2.3 A, and recovers the original state immediately after the ambient temperature drops to the recovery temperature, thereby resetting for a short time.

On the other hand, as indicated by the curve a, since the thermal switch 10 according to the present embodiment has an internal resistor unit, the heat generation temperature of the internal resistor unit is added to the heat generation temperature of the current limiting resistor 39, and the switch operates by the current of 1 A, and the self-holding works until the heat generation temperature of the current limiting resistor 39 drops to a considerably low level, thereby performing the resetting for a long time.

In the embodiment 1 described above, the connection between the thermal switch 10 and the current limiting resistor 39 is incorporated into the space between the AC power supply 33 and the primary side of the rectifier circuit 35, but the present embodiment is not limited to this configuration, but can be incorporated into the space between the secondary side of the rectifier circuit 35 and the capacitor 37 for the same effect.

That is, in any electric circuit having a current limiting resistor for limiting the rush current from a DC power supply to a load, the thermal switch 10 can be installed in the above-mentioned connecting method to the current limiting resistor of the electric circuit.

In the embodiment 1 described above, the thermal switch 10 is provided close to the current limiting resistor 39 to add the heat generation temperature of the internal resistor unit (narrow unit 18) of the thermal switch 10 to the heat generation temperature of the current limiting resistor 39, thereby operating (the bimetal 5 of) the thermal switch 10. However, the present embodiment is not limited to this configuration.

That is, although the thermal switch 10 is provided away from the current limiting resistor 39, the internal resistor unit detects the current and generates heat, thereby enabling the thermal switch 10 to operate alone, and obtaining the same effect and result as described above if the connection to the electric circuit 40 is made in the method described above.

Embodiment 2

Described above is an example mainly corresponding to the rush current. However, when an overhead wire as well as a power supply unit is applied outdoors like in Japan etc., a lightning arrestor is provided for an indoor power supply system, that is, an indoor wiring, at a necessary point in case of an external surge.

In an outdoor overhead wiring as well as the communication circuit such as a telephone circuit in addition to a power supply line, there is the possibility that an electric part in equipment is damaged or a fire occurs. To limit the surge voltage, a lightning arrestor can be provided in a power supply system and each equipment unit in many cases.

In a general indoor power supply system, especially a number of illumination devices adopt an LED. A recent LED is considerably improved in brightness, and its lightness has reached a no lower level than other lightning devices such as a fluorescent light etc., and a further propagation is expected.

In this case, the power supply of the DC system for illumination does not require a large current, and several amperes are to be used. However, although an LED illumination device has a long life, it is expensive, and various protective devices are normally incorporated into LED illumination equipment.

The above-mentioned lightning arrestor is used as the protective device in many cases. A lightning arrestor may use a nonlinear resistance element such as a varistor etc., a discharge tube in which a specific gas is enclosed, and a semiconductor technique. Each of them is selected depending on each characteristic.

Among them, the varistor is subject to a short circuit by a sudden impedance drop between the terminals when the surge voltage exceeds the varistor voltage, and it is necessary to devise protection against the short circuit. In the case of a discharge tube, there is the possibility of overheat by continuous discharge caused when an AC is applied. In addition, a semiconductor device has the characteristic of no large surge resistance. Thus, since there are unique characteristics, precautions are required.

Since a gas-filled discharge tube called a gas arrestor is quick in operation and has high surge resistance, it is reliable and widely used. However, in using a DC, it is necessary to have a measure in continuing the above-mentioned arc discharge. The measure can be a safe plan to short circuit an element using an external electrode during the heating process, which cannot be used again after starting an operation.

When the thermal switch with three terminals according to the present embodiment is connected to the above-mentioned gas arrestor, the discharge of the gas arrestor can be stopped in a short time and it can be reused. The further information is described below as the embodiment 2.

Figure 5:
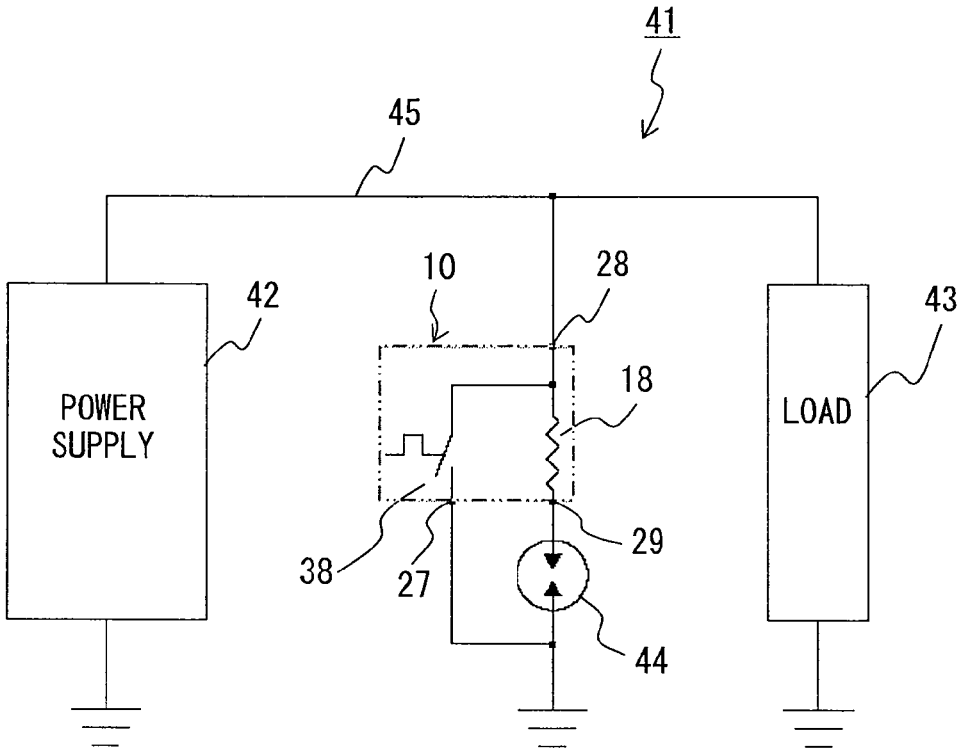
FIG. 5 is an example of connecting the thermal switch with three terminals illustrated in FIG. 2 to the electric circuit using a gas arrestor as a lightning arrestor used in equipment connected to an AC or a DC according to the embodiment 2.

FIG. 5 is an electric circuit used in the equipment to be connected to an AC or a DC in the embodiment 2, and is an example of connecting the thermal switch with three terminals in FIG. 2 to the electric circuit using a gas arrestor as a lightning arrestor.

A electric circuit 41 illustrated in FIG. 5 is configured by a power supply 42, a load 43, a gas arrestor 44, and the thermal switch 10. The gas arrestor 44 is connected parallel to the power supply 42 and the load 43 between a power supply wire 45 and the ground.

In the electric circuit 41, the external connection wire 27 (first terminal 8) of the thermal switch 10 is connected to the ground side wire of the gas arrestor 44, the external connection wire 29 (third terminal 22) is connected to the opposite wire, and the external connection wire 28 (second terminal 21) is connected to the power supply wire 45.

That is, the gas arrestor 44 is connected between the external connection wire 27 (first terminal 8) of the thermal switch 10 and the external connection wire 29 (third terminal 22), the external connection wire 27 (first terminal 8) is connected to the ground side, and the external connection wire 28 (second terminal 21) is connected to the power supply 42.

Although the connections of the external connection wires 27 and 29 are exchanged on the electric circuit 40, that is, the external connection wire 29 (third terminal 22) can be connected to the ground side wire of the gas arrestor 44 and the external connection wire 27 (first terminal 8) can be connected to the opposite wire with the same relationship in serial and parallel connections between the gas arrestor 44 and each unit of the thermal switch 10.

However, as described above, if the DC power supply is applied, the discharge is continued once it is started. Therefore, it is necessary to stop the discharge by decreasing the voltage to the level lower than the minimum arc voltage or decreasing the discharge current to the current smaller than the current by which the arc discharge is maintained.

Generally, a gas arrestor is produced by brazing an electrode to both end of a ceramic cylinder. Therefore, preferable thermal contact cannot be acquired although a rectangular thermal switch is arranged in contact with a gas arrestor, and the thermal response of a thermal switch has not been good conventionally.

The relationship between the electric circuit 41 according to the present embodiment and the thermal switch 10 is set by connecting the internal resistor unit (narrow unit 18) of the thermal switch 10 to the gas arrestor 44 in series, and connecting these components parallel to the connection unit (switch unit 38) of the thermal switch 10.

When the external surge exceeds the discharge start voltage of the gas arrester 44, the discharge starts in the gas arrestor 44. Since the surge voltage is very high at this moment, a very large current of several κA may pass for an exceedingly short time. However, the value of the discharge current passing after absorbing a surge voltage depends on the resistance of a power supply system, and may reach several amperes or several tens of amperes.

In the thermal switch 10, the internal resistor unit (narrow unit 18) connected in series with the gas arrestor 44 generates heat by the current while the discharge of the gas arrestor 44 is continued. The total of the temperature rise by the heat generation, the temperature rise of the gas arrestor 44 itself, and the temperature rise by the heat generation by the discharge current makes the thermal switch 10 reach the operation temperature in a short time.

Thus, the thermal switch 10 operates in a shorter time than in the case in which it operates only by an ambient temperature, closes the switch unit 38, and short-circuits the point between the power supply wire 45 and the ground. By the short circuit, the arc discharge in the gas arrestor 44 stops.

By the stop of the arc discharge, the current of the internal resistor unit (narrow unit 18) connected in series with the gas arrestor 44 stops, and the heat generation also stops.

A current determined by the voltage and the resistance of the DC power supply system passes through the contact (switch unit 38) of the thermal switch 10. However, since the current in the circuit is not large for LED illumination as described above, the heat generation at the contact with the short circuit current is low, and the inversion of the bimetal 5 is soon recovered, the switch unit 38 of the thermal switch 10 is released, and the function of reusing the lightning arrestor (gas arrestor 44) in the electric circuit 41 is recovered.

In the electric circuit 41, since the thermal switch 10 is in an OFF stage at the normal temperature, and the gas arrestor 44 is normally used at the discharge start voltage or less, no current passes through the circuit to which the thermal switch 10 and the gas arrestor 44 is connected.

At this moment, when a surge voltage such as an inductive lightning surge etc. is externally applied and exceeds the discharge start voltage, discharge starts in the gas arrestor 44. Then, by dropping the voltage at both ends of the 44 finally to the arc voltage, the gas arrestor 44 absorbs the external surge voltage.

<Variation Example of Embodiment 2>

Depending on the voltage of a DC power supply system, cutoff arc discharge may occur between the contacts when the thermal switch 10 is recovered. If a capacitor of a relatively large capacity is connected parallel to the contacts, the charge to the capacitor starts simultaneously with the release of the contacts, thereby reducing the voltage build-up speed between the contacts.

Figure 6:
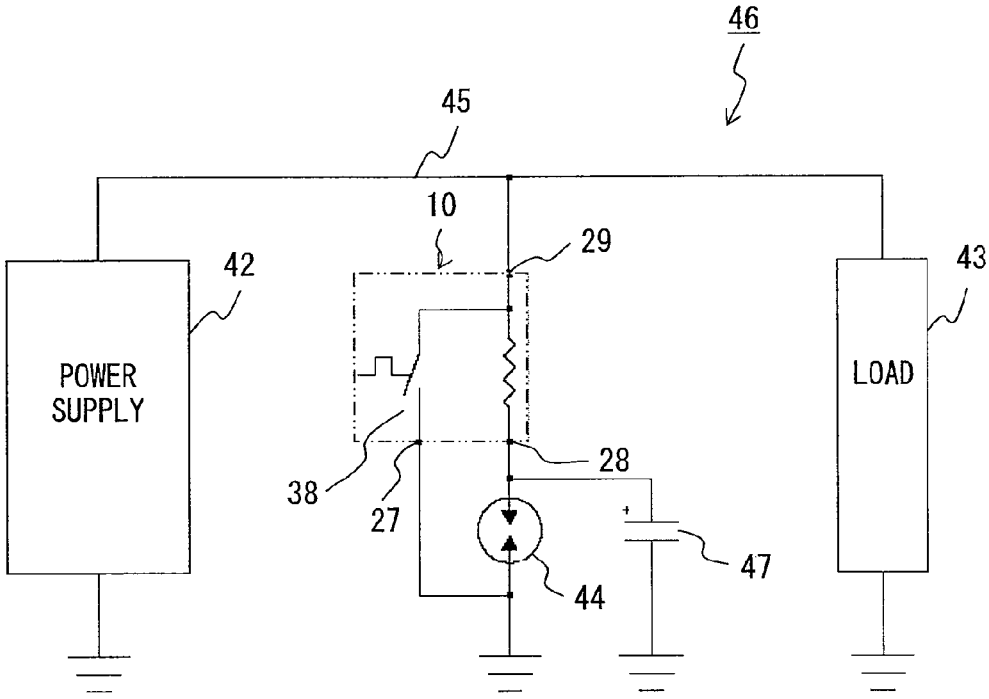
FIG. 6 is an example of connecting a capacitor having a relatively large capacity in parallel to a contact (switch unit) as a variation example of the embodiment 2.

FIG. 6 is an example of connecting a capacitor having a relatively large capacity in parallel to a contact (switch unit 38) as a variation example of the embodiment 2. In FIG. 6, the same component as that illustrated in FIG. 5 is assigned the same reference numeral.

In a circuit where a capacitor 47 is connected parallel to a contact (switch unit 38) as an electric circuit 46 in FIG. 6, the capacitor 47 is connected between the first terminal of the thermal switch 10 and the second or third terminal.

Thus, the voltage build-up speed between the contacts (switch unit 38) when they are released can be reduced, and the start of the discharge between the contacts can be consequently suppressed.

Relating to the discharge between the contacts, it is empirically understood that no discharge occurs between the contacts if the contact voltage at the termination of the release of the contacts is 20 V or less. Therefore, to set 20 V or less for the contact voltage at the termination of the release of the contacts, the capacity of the capacitor 47 is to be 1 μF or more, or preferably 47 μF or more although it depends on the circuit voltage or the circuit impedance of the electric circuit 46.

The capacitor 47 of a larger capacity can more successfully protect the contact (switch unit 38) against the discharge. The capacitor 47 normally has no effect externally, and starts discharge first on the gas arrestor 44 side in an abnormal state, thereby requiring no worry about undesired effect such as deposition on the contact.

The use of the electric circuit 46 to which the above-mentioned thermal switch 10 is connected can applied to an LED illumination circuit, a communication circuit, an equipment unit in a DC power supply system to be implemented hereafter.

As described above, according to the electric circuit to which the thermal switch with three terminals according to each embodiment and variation example of the present invention or the method for connecting the switch, the operation of the thermal switch not only generates heat of the current limiting resistor, but also generates heat depending on the current in the internal resistor unit of the thermal switch, thereby enabling the thermal switch to be operated in a short time.

Thus, the thermal switch operates before the temperature of the current limiting resistor largely rises, which short circuits the terminals of both ends of the current limiting resistors, thereby quickly recovering the current limiting resistor after the power supply is cut off.

When the current limiting resistor is a power thermistor, the thermal switch can be operated before the temperature of the power thermistor largely rises. Therefore, the temperature of the power thermistor which requires a long time to cool it after the temperature rises high.

Thus, the temperature of the power thermistor when a once cut off power supply is reactivated is low, and the power supply can be reactivated with a large current limiting resistor, and the current limiting effect can be maintained at quick power supply reactivation.

In addition, when a thermal switch is connected to an electric circuit having a lightning arrestor, and especially when the electric circuit is DC operated and the lightning arrestor is a gas arrestor, the additional heat generation of the internal resistor unit which has detected the current of the arc discharge causes a faster operation, that is, a faster short circuit on both ends of the gas arrestor than in the case in which the operation is performed only by the temperature rise of the gas arrestor, and the arc discharge can be safely stopped in the gas arrestor.

Furthermore, in an electric circuit having a lightning arrestor to which a thermal switch is connected, a capacitor of a relatively large capacity is connected parallel to a contact. Therefore, since the discharge is started to a capacitor simultaneously with the release of the contact, the voltage build-up speed between the contacts can be decreased.

Thus, regardless of the voltage and waveform of a DC circuit, the generation of the arc discharge between the contacts can be prevented by completing the contact releasing operation before the arc discharge start voltage is reached between the contacts when the thermal switch is recovered.

In this case, for the relatively large capacity of a capacitor, it is empirically preferable to set a build-up voltage at the release of contact to a capacity of 20 V or less until the operation of recovering the contact closed by the thermal operation of the bimetal at the heat generation of the internal resistor unit and opening it in the combination with the internal resistor unit. Thus, the generation of the arc discharge between the contacts can be avoided.

The present invention can be applied to an electric circuit connected to a thermal switch with three terminals and a method for connecting the switch.

REFERENCE NUMERALS

1 body of the thermal switch
2 fixed conductor
3 insulator
4 movable plate
5 bimetal
6 resin block
7 fixed contact
8 first terminal
9 column
11 hole
12 fixing unit
13 movable contact
14, 15 hooked nail
16 bimetal holding plane
17 long slit
18 narrow unit
19 wide unit
21 second terminal
22 third terminal
23 projection
24 central portion
25 through hole
26 step part
27, 28, 29 external connection wire
30 housing
31 enclosure member
32 power supply switch
33 AC power supply
34*a*, 34*b* wiring
35 rectifier circuit
36*a*, 36*b* output wiring
37 capacitor
38 switch unit
39 current limiting resistor
40 electric circuit
41 electric circuit
42 power supply
43 load
44 gas arrestor
45 power supply wire
46 electric circuit
47 capacitor

The invention claimed is:

1. An electric circuit connected to a thermal switch with three terminals, comprising:

a fixed conductor having a fixed contact; a first terminal incorporated into the fixed conductor as a unitary construction for external connection; a movable plate formed by an elastic substance provided with a movable contact facing the fixed contact and having a specified contact pressure; a second terminal formed at an opposite end point with respect to the movable contact of the movable plate for external connection; a third terminal provided adjacent to an internal resistor unit and formed as branching from contact by a slit from an end portion where the second terminal is formed; and a bimetal element engaged with the movable plate and inverted at a specified temperature, with the thermal switch with three terminals having a configuration of the contact which is in an OFF position in a normal temperature, and closing the contact according to a thermal operation, wherein:

the electric circuit is connected to a thermal switch with three terminals having lightning arrestor used in equipment connected to an AC or a DC power supply;

the lightning arrestor is connected between the first and third terminals;

the second terminal is connected to the power supply side and the first terminal is connected to a ground side, or the second terminal is connected to the ground side and the first terminal is connected to the power supply side; and a capacitor of a specified capacity is connected parallel to the first and second terminals, or the first and third terminals.

2. The electric circuit according to claim 1, wherein the relatively large capacity of a capacitor refers to a build-up voltage at the release of contact to a capacity of 20 V or less until the operation of recovering the contact closed by the thermal operation of the bimetal at the heat generation of the internal resistor unit and opening the contact in a combination with the internal resistor unit.

3. An electric circuit connected to a thermal switch with three terminals, comprising:

a fixed conductor having a fixed contact;

a first terminal incorporated into the fixed conductor as a unitary construction for external connection;

a movable plate formed by an elastic substance provided with a movable contact facing the fixed contact and having a specified contact pressure;

a second terminal formed at an opposite end point with respect to the movable contact of the movable plate for external connection;

a third terminal provided adjacent to an internal resistor unit and formed as branching from contact by a slit from an end portion where the second terminal is formed; and a bimetal element engaged with the movable plate and inverted at a specified temperature, with the thermal switch with three terminals having a configuration of the contact which is in an OFF position in a normal temperature, and closing the contact according to a thermal operation, wherein:

the electric circuit is an electric circuit including a current limiting element, the current limiting element is connected between the first and second terminals, the third terminal is connected to a power supply side and the first terminal is connected to a load side, or the third terminal is connected to the load side and the first terminal is connect to the power supply side, an internal resistor unit is connected serially to the current limiting element, and even if the current control resistor is short-circuited by the thermal switch after an operation, the internal resistor continues head generation by conducting current.

4. An electric circuit connected to a thermal switch with three terminals, comprising:

a fixed conductor having a fixed contact;

a first terminal incorporated into the fixed conductor as a unitary construction for external connection;

a movable plate formed by an elastic substance provided with a movable contact facing the fixed contact and having a specified contact pressure;

a second terminal formed at an opposite end point with respect to the movable contact of the movable plate for external connection;

a third terminal provided adjacent to an internal resistor unit and formed as branching from contact by a slit from an end portion where the second terminal is formed; and a bimetal element engaged with the movable plate and inverted at a specified temperature, with the thermal switch with three terminals having a configuration of the contact which is in an OFF position in a normal temperature, and closing the contact according to a thermal operation, wherein:

the electric circuit is an electric circuit including a current limiting element, the current limiting element is connected between the first and third terminals, the second terminal is connected to a power supply side and the first terminal is connected to a ground side, or the second terminal is connected to the ground side and the first terminal is connected to the power supply side, and current is continuously applied to an internal resistor unit the thermal switch operates and after the operation, the thermal switch stops the current to the internal resistor unit.

* * * * *